US009607781B2

(12) United States Patent
Albrecht et al.

(10) Patent No.: US 9,607,781 B2
(45) Date of Patent: Mar. 28, 2017

(54) TAP CHANGER AND VACUUM INTERRUPTER FOR A TAP CHANGER OF THIS KIND

(75) Inventors: Wolfgang Albrecht, Wenzenbach (DE); Christian Hammer, Regensburg (DE); Werner Hartmann, Weisendorf (DE); Silvio Kosse, Erlangen (DE); Andreas Lawall, Berlin (DE); Roman Renz, Berlin (DE); Astrid Renz, legal representative, Berlin (DE); Andreas Stelzer, Berlin (DE); Joerg Teichmann, Alzenau (DE); Norbert Wenzel, Erlangen (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 552 days.

(21) Appl. No.: 13/878,059

(22) PCT Filed: Nov. 10, 2011

(86) PCT No.: PCT/EP2011/005641

§ 371 (c)(1), (2), (4) Date: Sep. 25, 2013

(87) PCT Pub. No.: WO2012/072181

PCT Pub. Date: Jun. 7, 2012

(65) Prior Publication Data

US 2014/0034463 A1 Feb. 6, 2014

(30) Foreign Application Priority Data

Nov. 30, 2010 (DE) ..... 10 2010 053 466

(51) Int. Cl.
*H01H 9/00* (2006.01)
*H01F 29/04* (2006.01)
*H01H 33/666* (2006.01)

(52) U.S. Cl.
CPC ..... *H01H 9/0038* (2013.01); *H01F 29/04* (2013.01); *H01H 2033/6668* (2013.01)

(58) Field of Classification Search
CPC ..... H01F 29/04; H02P 13/06; H01H 9/0038
USPC ... 200/11 TC, 7, 11 R, 11 K, 14, 17 R, 16 R, 200/564, 336, 400
See application file for complete search history.

(56) References Cited

FOREIGN PATENT DOCUMENTS

| | | | |
|---|---|---|---|
| DE | 2021575 | A | 12/1971 |
| DE | 3344376 | A | 12/1983 |
| DE | 19756308 | B | 3/1999 |
| DE | 102004004530 | A | 9/2007 |
| DE | 102006033422 | B | 11/2007 |
| DE | 102009048813 | A | 4/2011 |
| EP | 0258614 | A | 3/1988 |

(Continued)

*Primary Examiner* — Edwin A. Leon
*Assistant Examiner* — Iman Malakooti
(74) *Attorney, Agent, or Firm* — Harness, Dickey & Pierce, P.L.C.

(57) ABSTRACT

A tap changer for uninterrupted switching between winding taps of a tapped transformer has first and second load branches for each phase to be switched. Each load branch has a main vacuum switch and in parallel thereto a series connection of a switch-over resistance and a respective auxiliary vacuum switch. First and second vacuum switching tubes each contain the main vacuum switch of the respective first and second load branches and the auxiliary vacuum switch of the other of the load branches.

7 Claims, 2 Drawing Sheets

(56) References Cited

FOREIGN PATENT DOCUMENTS

| | | | |
|---|---|---|---|
| EP | 2085995 | A | 8/2009 |
| EP | 2200060 | A | 6/2010 |

TAP CHANGER AND VACUUM INTERRUPTER FOR A TAP CHANGER OF THIS KIND

CROSS REFERENCE TO RELATED APPLICATIONS

This application is the US-national stage of PCT application PCT/EP2011/005641 filed 10 Nov. 2011 and claiming the priority of German patent application 102010053466.8 itself filed 30 Nov. 2010.

FIELD OF THE INVENTION

The invention relates to a tap changer with vacuum switching tubes for uninterrupted switching between winding taps of a tapped transformer. The invention further relates to a novel vacuum switching tube particularly suitable for such a tap changer.

BACKGROUND OF THE INVENTION

A tap changer having in total four vacuum switching tubes per phase is known from DE 20 21 575. Provided in each of the two load branches are a respective vacuum switching tube as main switch and a respective further vacuum switching tube, in series connection with a switch-over resistance, as resistance switch.

In the case of uninterrupted load changeover from the previous winding tap n to a new, preselected winding tap n+1 initially the main switch of the side switching off is opened and thereupon the resistance switch of the side taking over closes so that a compensating current limited by the switch-over resistors flows between the two taps n and n+1. After the previously closed resistance switch of the side switching off has opened, the main switch of the side taking over then closes so that the entire load current is conducted from the new winding tap n+1 to the load concluding the changeover.

A further tap changer in which further mechanical switch elements are provided between the electrical connection of the two vacuum switching tubes of each load branch and the load is described in DE 10 2009 048 813 that is not prior published.

The known tap changer requires four separate vacuum switching tubes per phase. In the first instance, the large amount of space required for these vacuum switching tubes themselves, as well as the associated actuated mechanism is disadvantageous. Moreover, due to the high component outlay such known constructions are relatively expensive.

OBJECT OF THE INVENTION

It is the object of the invention to indicate a tap changer which, for the same functionality, is of simpler construction, in which the switching elements need less space and are, in addition, less expensive.

Moreover, it is an object of the invention to indicate a vacuum switching tube which is usable, with particular advantage, for such a further developed tap changer.

SUMMARY OF THE INVENTION

The tap changer according to the invention is based on the general idea of combining the main switch in one load branch and the resistance switch in the other load branch to form a single vacuum switching tube.

Moreover, the vacuum switching tube according to the invention is based on the general idea of combining the functionality of two tubes in a tap changer through the combination of a constructional form of a tube with only one movable contact system and two alternative—depending on the type of changeover switch—contactable fixed contacts. In that case, the novel vacuum switching tube is of simple construction; it does not have, in particular, any internally located contact compression springs or slide contacts. Particularly advantageous in the case of the vacuum switching tube according to the invention is the single movable contact system that occupies less space and requires only a simple actuating mechanism.

Vacuum switching tubes with two contact locations are already known per se.

DE 333443767 relates to a vacuum switching tube with two contact pairs that are electrically connected in series in a single vacuum space, the contact pairs being actuatable simultaneously.

DE 197 56 308 C1 relates to a similar vacuum switching tube with two switch paths on a common axis, where internally disposed contact compression springs are provided.

EP 0 258 614 B1 describes the combination of a vacuum switching tube and a specific electrical connection with a tap changer. In this case, several switching paths are arranged in one vacuum space, which causes a complicated construction of the vacuum switching tube with annular fixed contacts.

Finally, DE 10 2006 033 B3 describes a further vacuum switching tube with a multiple functionality, where here, too, not only annular fixed contacts, but also internally disposed contact pressure springs are required.

None of these known solutions is suitable for a tap changer according to the invention.

BRIEF DESCRIPTION OF THE DRAWING

The invention shall be explained in more detail in the following by way of example with reference to drawings, in which.

SPECIFIC DESCRIPTION OF THE INVENTION

Figure 1:
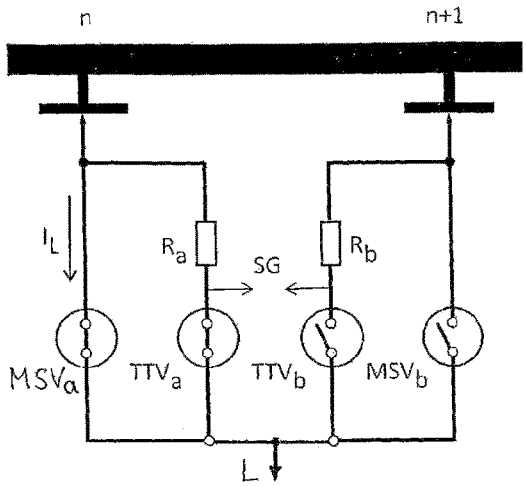
Fig. 1 Prior Art
FIG. 1 shows a tap changer according to the prior art.

A known tap changer is shown in FIG. 1. It has a first load branch in which a vacuum switching tube $MSV_a$ acting as a main switch as well as parallel thereto a switch-over resistance $R_a$ and a vacuum switching tube $TTV_a$ acting as a resistance switch. In entirely analogous manner, the second load branch comprises a vacuum switching tube $MSV_b$ as well as parallel thereto a further switch-over resistance $R_b$ and a vacuum switching tube $TTV_b$. The known tap changer thus has two vacuum switching cells per load branch, therefore four vacuum switching cells per phase in total.

Figure 2:
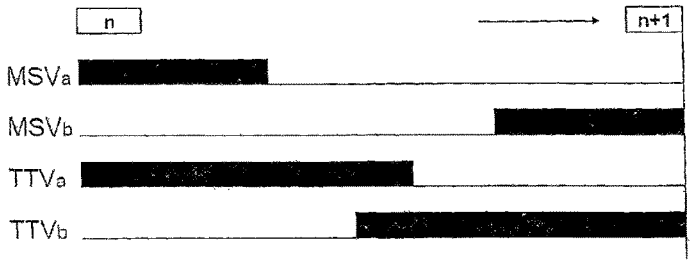
FIG. 2 shows a changeover sequence of such a known tap changer.

FIG. 2 shows the switching sequence of such a known tap changer in the case of changeover from the winding tap n to the winding tap n+1. The starting position, in which the tap n is electrically connected, corresponds with the setting of the individual switching elements illustrated in FIG. 1. The changeover takes place in the following steps:

$MSV_a$ opens $TTV_b$ closes $TTV_a$ opens $MSV_b$ closes;

the changeover is concluded.

Figure 3:
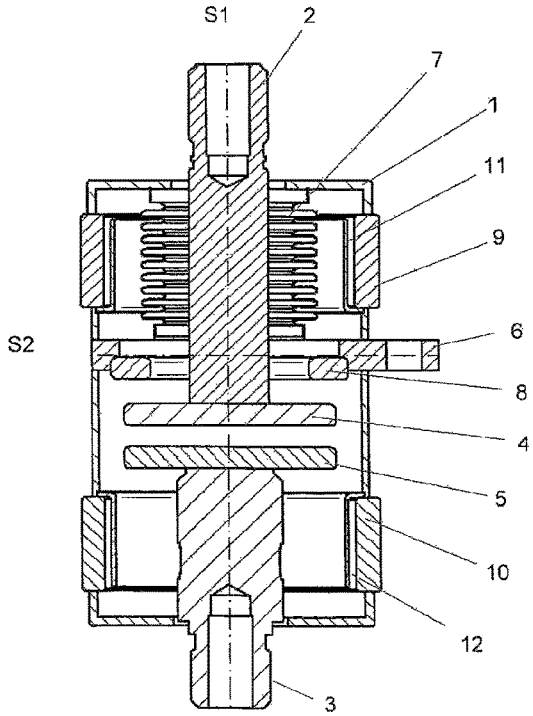
FIG. 3 shows a vacuum switching tube according to the invention.

FIG. 3 shows a combined vacuum switching tube according to the invention. It has a common housing 1. Provided centrally on the longitudinal rotation-symmetry axis s1 is an upper movable plunger 2 and, at the opposite end, a lower fixed contact terminal 3. The movable plunger 2 carries a movable contact member 4 at its inner free end. The fixed lower contact terminal 3 itself carries a fixed contact member 5. Provided above the movable contact member 4 is an upper encircling annular stationary contact arrangement 6 that extends perpendicular to the longitudinal rotation-symmetry axis S1 in the plane S2 that is here illustrated to be horizontal. A fixed contact 8, which is, for example, soldered, is fastened to the contact arrangement 6. The fixed contact 8 is, in an end setting of the movable plunger 2, electrically contactable by the contact member 4 thereof. In the other end setting this contact member 4 electrically connects the stationary contact member 5 of the lower contact terminal 3. The movable contact member 4 can thus electrically connect, in the manner of a changeover switch, selectably not only the stationary contact 8, but also the stationary contact member 5. Bellows 7 are illustrated as well as upper and lower ceramic members 9, 10, and in the interior of the housing 1 an upper attenuating screen 11 and a lower attenuating screen 12.

Overall, several advantages are achieved with the tap changer according to the invention with vacuum switching tubes according to the invention: The number of vacuum switching tubes necessary is de facto halved; the need for space for these switching elements is correspondingly smaller. Costs are similarly reduced. This is achieved by the vacuum switching tube used in accordance with the invention that is constructed as a "tandem tube" and, in particular, contains two separate switches, but only a single movable contact.

In that case, the vacuum switching tube according to the invention is of simple construction; by contrast to the solutions known from the prior art it needs neither internally disposed contact compression springs nor complicated actuating mechanisms or special cage-like contact constructions.

Figure 4:
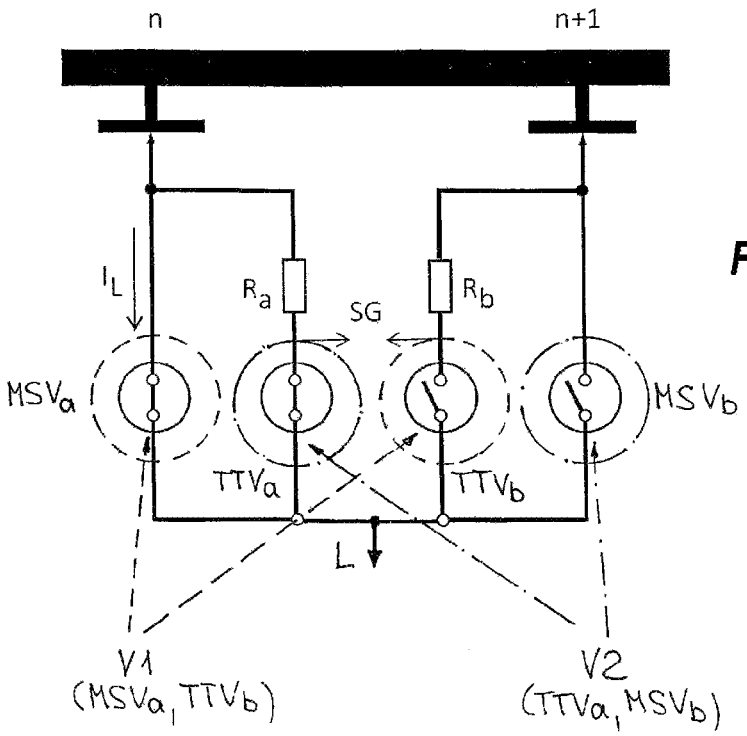
FIG. 4 shows a tap changer according to the invention with two vacuum switching tubes according to the invention in schematic illustration and FIG. 5 shows a further tap changer according to the invention.

FIG. 4 shows schematically a tap changer with two load branches, as has already been explained in FIGS. 1 and 2. It can be seen that here, according to the invention, the vacuum switching tube $MSV_a$ acting as a main switch of the first load branch and the vacuum switching tube $TTV_b$ acting as a resistance switch of the second load branch are combined into a first vacuum switching tube V1 according to the invention. Equally, the vacuum switching tube $MSV_b$ acting as a main switch of the second load branch and the vacuum switching tube $TTV_b$ acting as a resistance switch of the first load branch are combined into a second vacuum switching tube V2 according to the invention.

This takes place in that in the case of the first vacuum switching tube V1 according to the invention, for example, the contact path between fixed contact member 5 and movable contact member 4 connected to the load L takes over the function of the main switch $MSV_a$, and the contact path between fixed contact 8 and movable contact member 4 takes over the function of the resistance switch $TTV_b$. In entirely analogous manner in the case of the second vacuum switching tube V2 according to the invention, for example, the contact path between the fixed contact member 5 and movable contact member 4 takes over the function of the main switch $MSV_b$, the contact path between fixed contact 8 and movable contact member 4 takes over the function of the resistance switch $TTV_a$. Obviously, other electrical connections of the contact paths of the two vacuum switching tubes V1, V2 are also possible within the scope of the invention.

Figure 5:
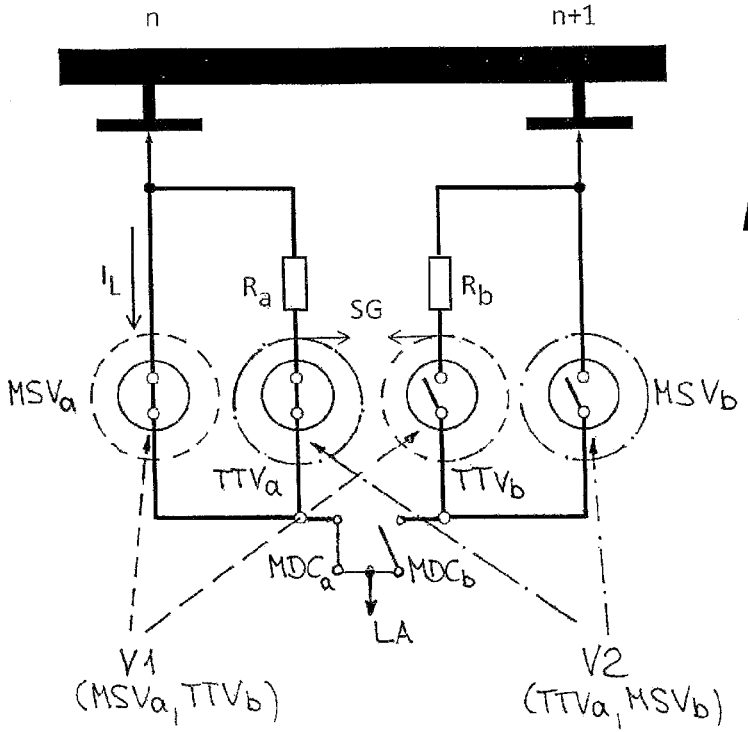

FIG. 5 shows a further tap changer according to the invention, in which additional mechanical switching elements ($MDC_a$, $MDC_b$) are provided that serve for electrical insulation of the load branch not conducting the load current to the load LA.

In all forms of embodiment the advantage of the invention consists in that only two vacuum switching tubes each with only one movable contact member, which is to be driven, are required in order to replace in total four separate vacuum switching tubes in the two load branches.

The invention claimed is:

1. A tap changer for uninterrupted switching over between winding taps of a tapped transformer, the tap changer comprising:

first and second load branches for each phase to be switched, each load branch including a main vacuum switch and in parallel thereto a series connection of a switch-over resistance and a respective auxiliary vacuum switch a single first vacuum switching tube holding the main vacuum switch of the first load branch and the auxiliary vacuum switch of the second load branch, a single first movable contact in the single first vacuum switching tube, two fixed first contacts in the single first vacuum switching tube and selectably connectable by the single first movable contact, a single second vacuum switching tube holding the main vacuum switch of the second load branch and the auxiliary vacuum switch of the first load branch, a single second movable contact in the single second vacuum switching tube, two fixed first contacts in the single second vacuum switching tube and selectably connectable by the single second movable contact, the first and second movable contacts of the first and second vacuum switching tubes being connected directly or through mechanical switching elements with a common load.

2. The tap changer according to claim 1, wherein each vacuum switching tube comprises:

a common housing centered on and rotation-symmetrical to an upright longitudinal axis, a single axially movable plunger in the housing, a lower fixed contact terminal in the housing below the single axially movable plunger, a single movable contact member on the movable plunger, a lower fixed contact member on the lower contact terminal, and an upper fixed contact member in the housing above the lower fixed contact member and positioned such that, on downward movement of the movable plunger, the single movable contact member disengages from the upper fixed contact member and then engages the lower fixed contact member.

3. The tap changer according to claim 2, wherein the upper fixed contact member extends perpendicular to the longitudinal axis in a plane.

4. The tap changer according to claim 2, wherein the upper fixed contact member at least partly surrounds the plunger.

5. The tap changer according to claim 2, wherein the fixed upper contact member is connected directly to the respective tap and the lower fixed contact member is connected via a respective switchover resistance to the respective tap.

6. The tap changer according to claim 2, wherein the single movable contact member selectively contacts each of the first fixed upper contact member and the fixed lower contact member directly.

7. The tap changer according to claim 2, wherein the single movable contact member has first and second opposing surfaces, and in a first position of the single movable contact member, the first surface directly contacts the upper fixed contact member, and in a second position of the single movable contact member, the second surface directly contacts the lower fixed contact member.

* * * * *